US005624026A

United States Patent [19]

Chernoff

[11] Patent Number: 5,624,026

[45] Date of Patent: Apr. 29, 1997

[54] GARMENT HOLDING DEVICE FOR USE WITH VARIOUS TYPES OF LUGGGAGE

[76] Inventor: Don Chernoff, 10721 Sycamore Springs La., Great Falls, Va. 22066

[21] Appl. No.: 406,543

[22] Filed: Mar. 20, 1995

[51] Int. Cl.[6] ..... A45C 5/12; A45C 13/02

[52] U.S. Cl. ..... 206/289; 206/279; 206/293; 206/298; 190/110

[58] Field of Search ..... 190/102, 110, 190/109; 206/293, 291, 292, 298, 278, 289

[56] References Cited

U.S. PATENT DOCUMENTS

| | | | |
|---|---|---|---|
| 1,591,333 | 7/1926 | Neidlinger | 206/278 X |
| 1,987,722 | 1/1935 | Thiss | 190/109 X |
| 1,988,530 | 1/1935 | Wheary | 190/109 X |
| 2,138,202 | 11/1938 | Wilt | 190/109 X |
| 2,176,792 | 10/1939 | Currie | 206/293 X |
| 2,383,389 | 8/1945 | Illion | 206/278 |
| 2,422,511 | 6/1947 | Wolsey | 206/292 |
| 2,502,033 | 3/1950 | Bohn | 206/293 |
| 2,529,569 | 11/1950 | Overton | 190/110 |
| 2,585,745 | 2/1952 | Crosby | 190/109 X |
| 2,723,734 | 11/1955 | Bellamy | 190/110 |
| 3,035,673 | 5/1962 | Schenkler | 206/291 X |
| 3,128,854 | 4/1964 | Specht | 206/289 |
| 3,621,991 | 11/1971 | Richter | 206/289 |
| 3,729,038 | 4/1973 | Ekeson | 190/110 |
| 4,562,952 | 1/1986 | Chinman | 206/292 X |
| 4,598,803 | 7/1986 | Ghiassi | 190/102 X |
| 5,255,766 | 10/1993 | Deconinck | 206/293 X |

*Primary Examiner*—Sue A. Weaver

[57] ABSTRACT

A novel garment holding device for use with various types of luggage comprising a substantially cylindrical hollow tube about which suits and other garments can be completely wrapped, a fabric cover for holding garments securely about the outside surface of the tube, and a flexible hanger which is capable of holding suits and other garments against the outside of the tube while being flexible enough to conform to the curvature of the tube. A fabric cover wraps around the garments and the tube and holds the garments securely against the outer surface of the tube. Because the garments will be rolled instead of folded, wrinkling of the garments will be reduced. The hollow center of the cylinder is utilized to carry bulky and awkward shaped objects such as shoes and shaving or makeup kits. The tube, when holding a garment wrapped around its outer surface, can be carried inside any luggage of appropriate size. Because of the novel way the suits and garments are wrapped around the outside of a cylinder the overall shape of the luggage can be more compact and easier to carry.

8 Claims, 4 Drawing Sheets

GARMENT HOLDING DEVICE FOR USE WITH VARIOUS TYPES OF LUGGGAGE

FIELD OF THE INVENTION

This invention relates to luggage adapted to improve the transport of garments by an individual.

BACKGROUND OF THE INVENTION

Heretofore all luggage of the variety commonly called garment bags have been of one basic design. In these traditional garment bags, clothing on a hanger is attached at one end of a long rectangular bag and the bag is folded to reduce its size so it may be more easily carried. Shoes and other bulky objects are loaded into one end of the bag so that when the bag is folded and carried all the bulky objects are at the bottom of the bag, causing the bag to be substantially wider at the bottom than at the top. This also results in uneven weight distribution by putting much of the weight at the bottom of the garment bag.

The traditional design of garment bags suffers from two serious flaws. First they require the clothing within to be folded which results in wrinkles and creases in the garments. Second the shape of these garment bags is such that they are very bulky and awkward to carry. Furthermore because of the awkward shape of the garment bag it is difficult to fit it into storage bins on airplanes. It is especially true that this awkward shape makes it more difficult to lift the bag over ones head which is required to fit it into the overhead bin on an airplane.

Traditional garment bags are popular among business travelers since, up to now, they have been the only type of luggage available to carry suits and similar formal business garments. It is common to see a majority of passengers on a commercial airline flight carrying these types of garment bags. It is also common to see business travelers carry their luggage aboard the plane and stow it in either an overhead bin or under the seat in front of them, the two spaces provided by the airlines for luggage carried aboard flights. This helps to save time by eliminating the need to wait for checked bags after the plane has landed. It is advantageous to the passengers if their luggage fits easily into one of these two designated places. It is becoming more common for airlines to require that oversized and bulky pieces of luggage be checked into the cargo hold to avoid flight delays brought on by passengers struggling to make a piece of luggage fit into too small a space. Traditional garment bags are often too bulky to fit into either of these two designated storage sites. A further disadvantage of this design is that the bag must be folded in half to reduce it to a manageable size. This results in the clothing becoming wrinkled and not wearable in a business setting without subsequent ironing or pressing.

A newer variation of the traditional garment bag design tries to reduce the overall size of the luggage by folding twice so that the bag is divided into three sections. While this may reduce the external size of the bag it requires the garments to be folded in two places instead of only one thereby increasing the problem of wrinkling.

It is an object of the present invention to provide a novel garment carrying system which will minimize wrinkles, allow for easy and quick packing and unpacking, be useable with various types of luggage, and fit in a more compact space than traditional garment bags.

SUMMARY OF THE INVENTION

In accordance with the present invention a novel garment holding device for use with various types of luggage is described which allows for more efficient packing of garments and luggage of a size and shape to be comfortable to carry and to safely fit in standard storage locations aboard commercial airlines.

To accomplish these objectives the novel garment holding device includes a hollow plastic cylinder and flexible plastic hanger with means for attaching it to the outside of the cylinder. The cross section of the cylinder is preferably circular but can also be oval or elliptical in shape. The hanger is flexible so that it can conform to the curvature of the cylinder as the clothes are wrapped around the outside surface of the cylinder. The clothing and hanger are then held tightly against the outer cylinder surface with a fabric cover which can be stretched tightly to apply inward pressure to the clothing.

The first significant advantage of this invention is that garments no longer have to be folded and incur wrinkling, they can be gently wrapped around the outside of the cylinder. A new and significant advantage of this invention is that the space inside the cylinder is an efficient place to pack additional objects, especially potentially dirty ones such as shoes. By placing shoes inside the cylinder, any dirt on the shoes will be prevented from coming in contact with other clothing inside the luggage. Another significant advantage of this invention is that the space inside the hollow tube is also an ideal place to carry bulky objects such as shaving kits and makeup kits. Another significant advantage of this invention is that because of the shape of the cylinder it can fit in smaller luggage, of the type which can be comfortably carried over the shoulder or pulled on its wheels by a retractable handle, and fit into an airplane overhead storage bin or under an airline seat. This would not only be more convenient to the carrier of the luggage but it would improve storage efficiency and speed of boarding on airplanes where people spend extra time looking for places to store traditional garment bags.

Other objects and advantages of this invention will become apparent upon reading the following detailed description and upon reference to the drawings.

DETAILED DESCRIPTION

While the invention will be described in connection with a preferred embodiment, it will be understood that it is not intended to limit the invention to these embodiments. On the contrary, it is intended to cover all alternatives, modifications or equivalents as may be included within the spirit and scope of the invention as defined by the claims.

Figure 1:
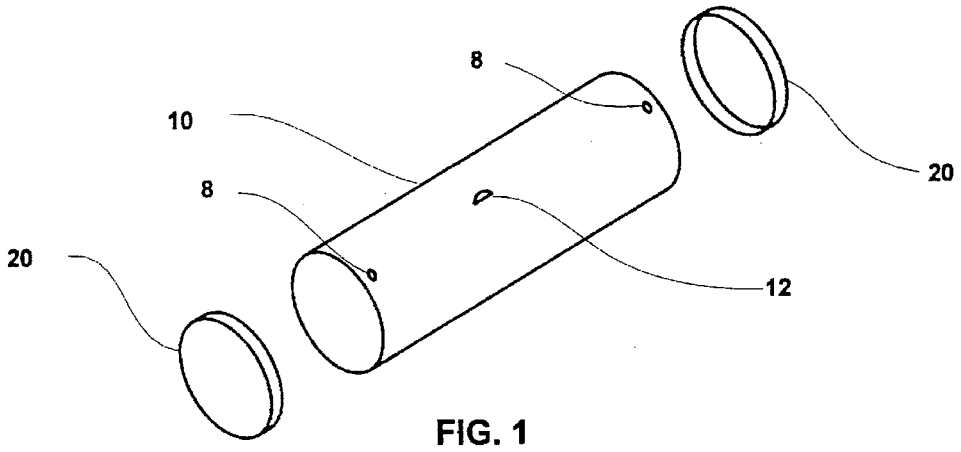
FIG. 1 is a perspective view of the cylinder.
Figure 2:
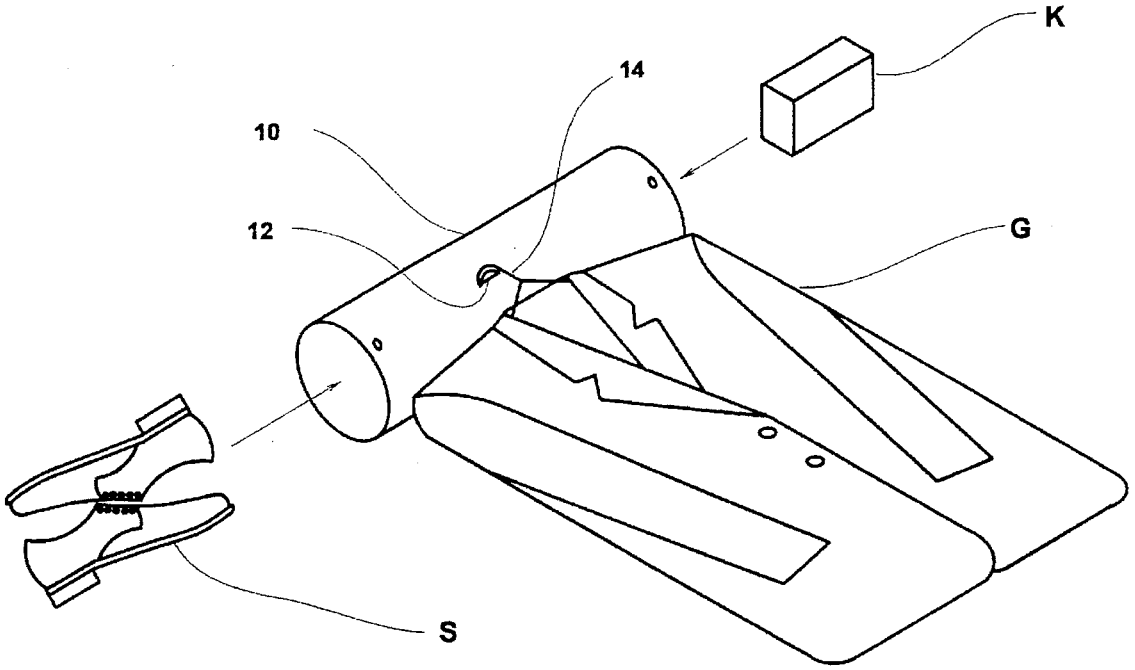
FIG. 2 is a perspective view of an embodiment of the invention being loaded.
Figure 3:
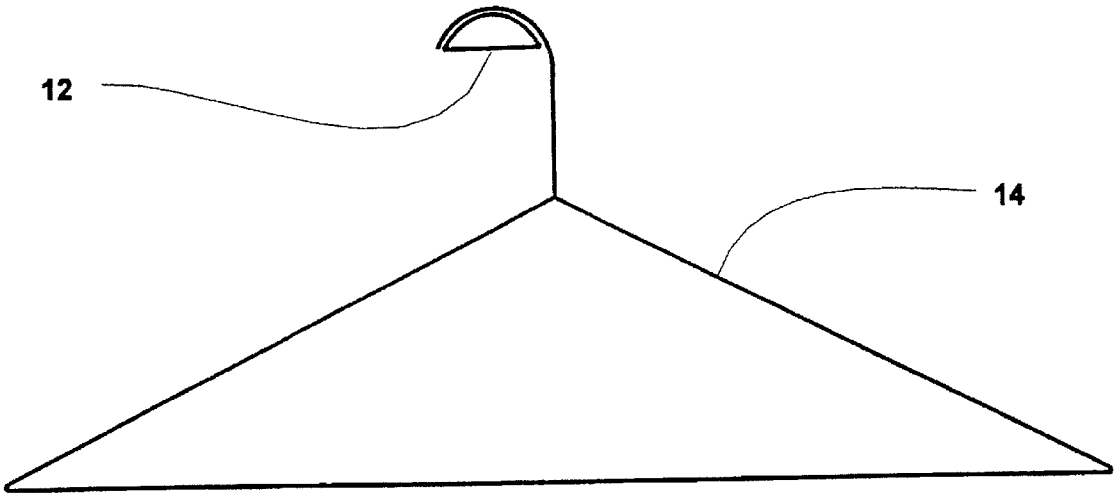
FIG. 3 is a plan view of the hanger attached to the cylinder.
Figure 4:
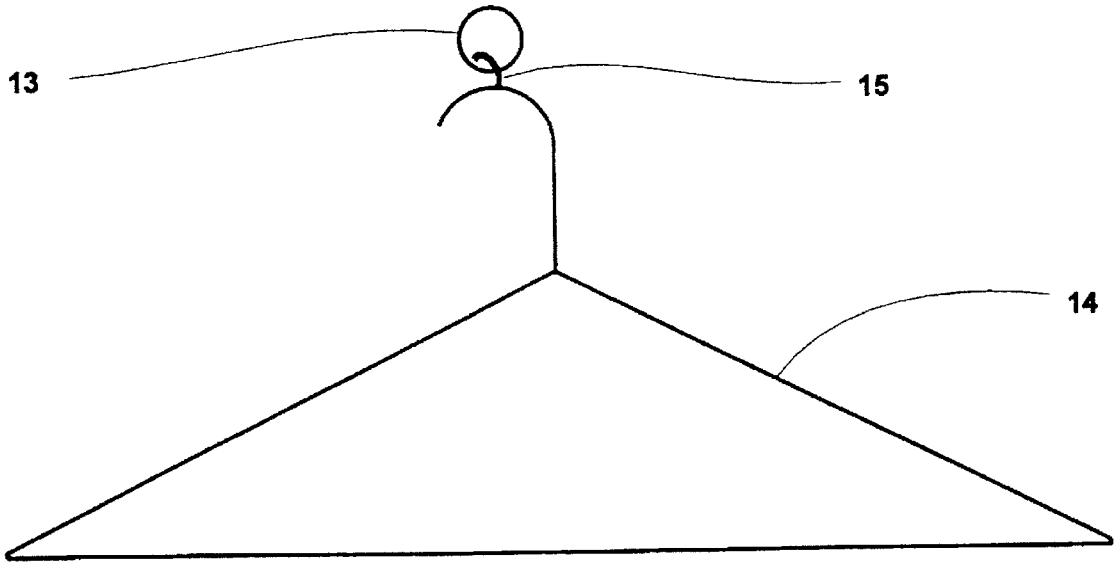
FIG. 4 is a plan view illustrating another embodiment of the hanger with integral hook at 90 degrees to the main hook for insertion into a hole in the cylinder.

Referring to the drawings in detail, FIG. 1 shows a hollow plastic cylinder 10 with inside diameter preferably between 4 and 7 inches and length preferably between 18 and 24 inches, with hanger attachment point 12. The cylinder is made of a rigid lightweight plastic such as ABS or Polyethylene and can be formed by extrusion, blow molding, rolled from a sheet or other similar technique of plastic forming. The drawing shows a hanger attachment point 12 on the cylinder 10 consisting of a piece of molded plastic shaped to fit the curvature of the hanger hook, attached by glue or fastener to the outside of the cylinder 10. FIG. 2 demonstrates one possible loading of the interior space of the cylinder 10 prior to wrapping the garments around the outside of the cylinder 10. In this embodiment a pair of shoes S, and a shaving/makeup kit K, are inserted into the interior of the cylinder. FIG. 2 shows a suit garment G and flexible hanger 14 attached by its primary hook 16 to cylinder 10 at point 12. The hanger 14 is preferably made of molded plastic and is flexible enough to conform to the outside curvature of the cylinder 10 when the assembly of garment and hanger is wrapped around the outside of cylinder 10, and also strong enough to hold a suit of clothing and hang from any closet rack which supports standard hangers. The hanger 14 can achieve the aforementioned properties due to its cross sectional shape which can be either substantially rectangular or of an I-beam design. Either cross sectional shape results in a hanger which is strong enough to carry the weight of a suit of clothing while hanging in a closet. Furthermore, either cross sectional shape allows the hanger to flexibly bend to conform to the outside diameter of the cylinder 10. An alternate method of attaching the hanger 14 to the cylinder 10, is to incorporate a second smaller hook 15 into the main hook 16 of the hanger 14 but at a 90 degree angle to the main hook. This smaller hook could then be inserted into a hole 13 in the cylinder wall. This alternate method is illustrated in FIG. 4. In this embodiment the hole 13 replaces the attachment point 12 as the primary means of attaching the hanger 14 to the cylinder 10. FIG. 3 shows an enlarged view of the hanger 14 attached by its primary hook 16 to the cylinder 10 at point 12.

Figure 5:
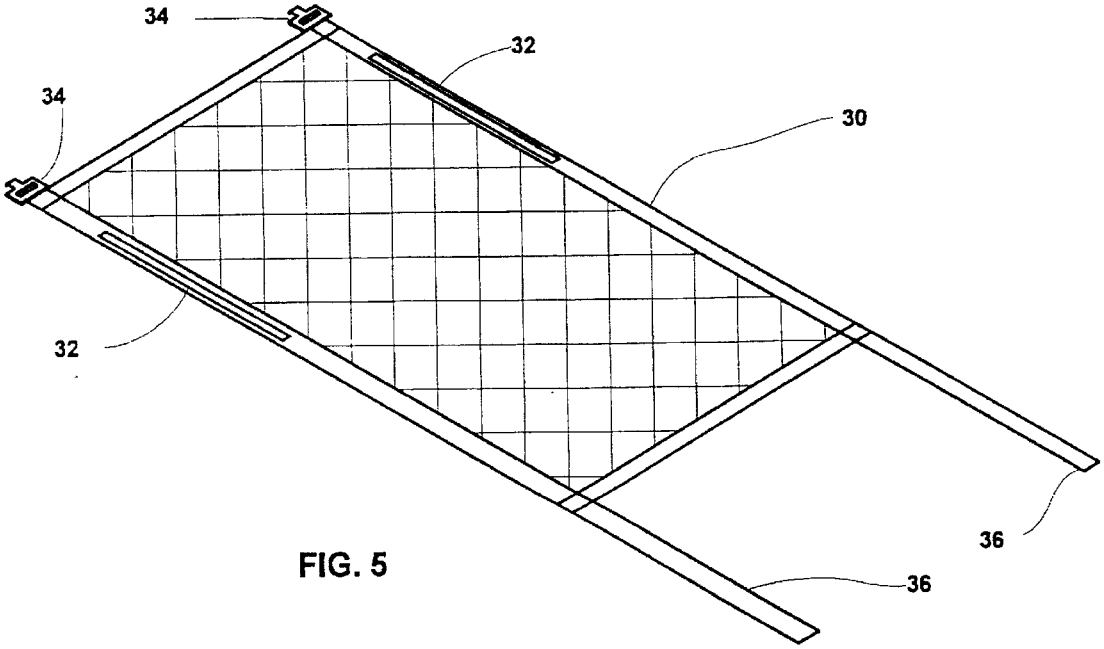
FIG. 5 is a perspective view of the mesh fabric cover.

FIG. 5 shows the mesh fabric cover 30. Hook and loop fastener tabs 36 will match up with hook and loop fastener pieces 32 when the fabric cover 30 is wrapped around itself.

Figure 6:
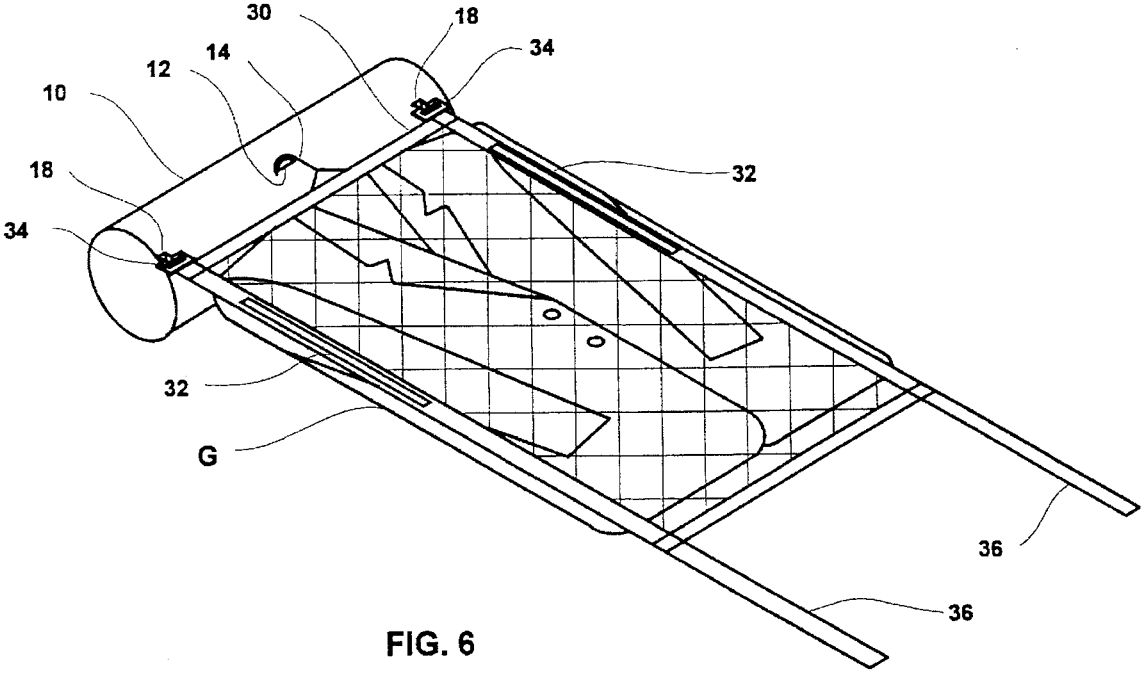
FIG. 6 is a perspective view showing the garments and fabric cover attached to the cylinder ready to be rolled up.

FIG. 6 shows clothing on hanger 14 attached to the cylinder 10 at point 12. The fabric cover 30 is attached to the cylinder 10 by inserting the two hooks 34 into the holes 8 near the ends of the cylinder 10. The entire assembly is now ready to be rolled up. This is best accomplished on a flat surface such as a bed or countertop. With the fabric cover 30 attached to the cylinder 10 the entire assembly is rolled forward so that the fabric cover 30 completely covers the clothing. Fabric cover 30 is pulled taught while being rolled up to provide compression of the garment G against the outside of cylinder 10. When the end of the fabric cover 30 has been reached it is secured in place by pressing the extended border hook and loop fastener tabs 36 onto the opposing border hook and loop fastener pieces 32 running along the edges of the fabric cover 30. By securing the fabric cover 30 in this way it prevents the suit garment G from moving when the entire assembly is inside a piece of luggage. This limiting of movement contributes to the prevention of wrinkling of the garment.

Figure 7:
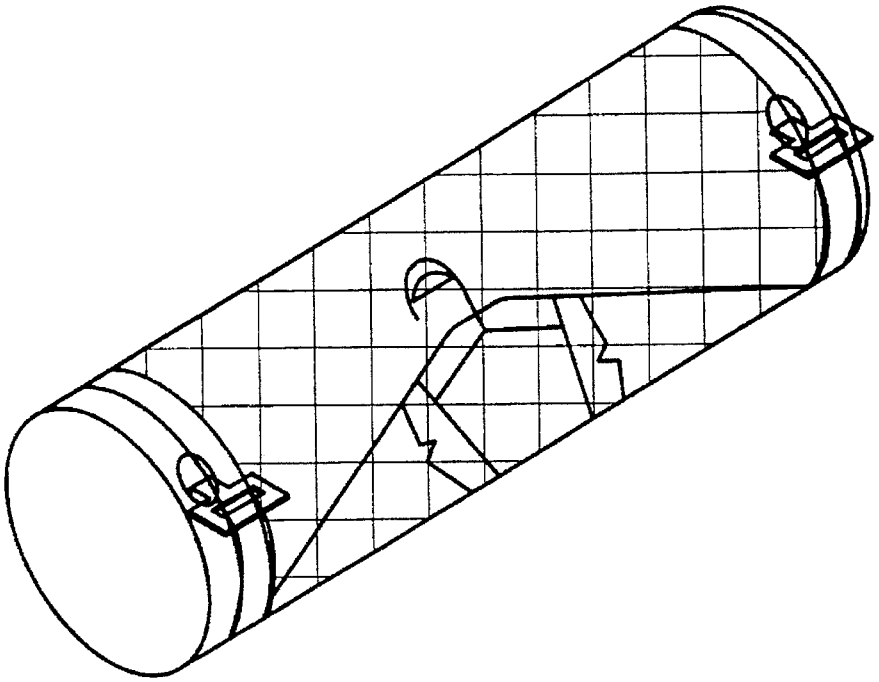
FIG. 7 is a perspective view of the invention completely packed and ready to load into luggage.
Figure 8:
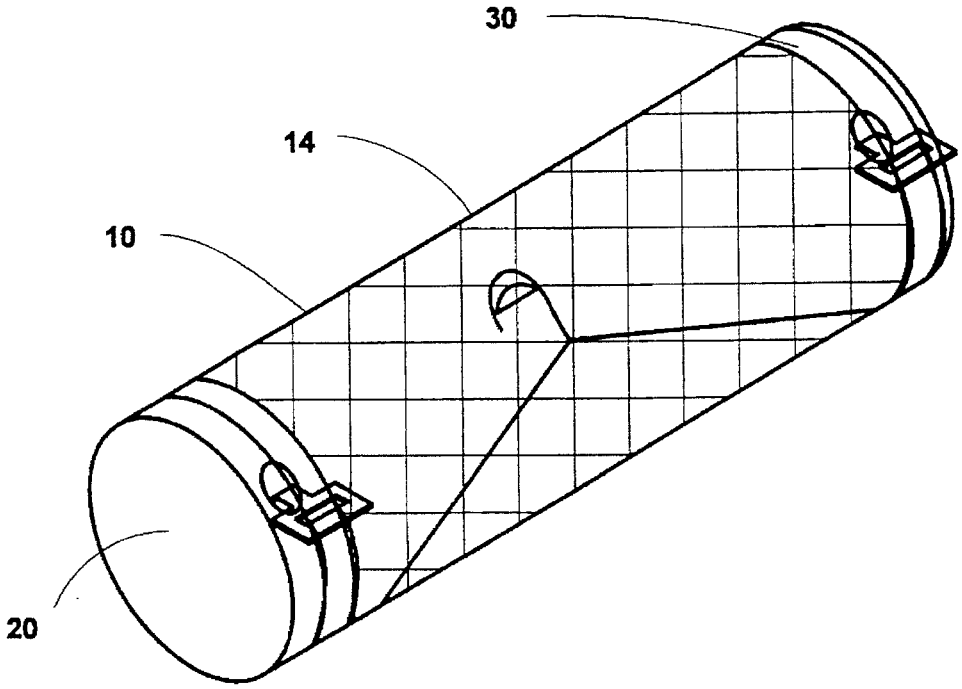
FIG. 8 is a perspective view of the invention completely packed shown with the garment removed for clarity.

FIG. 7 shows the completed assembly with clothing wrapped around the outside surface of the cylinder 10 protected and held in place by the fabric cover 30 while accessories such as shoes S, are inside the cylinder 10. The assembly with the rolled up and protected garments is now ready to be placed into a piece of luggage. Additional garments and accessories can be placed around the cylinder assembly to complete the packing process. For clarity FIG. 8. shows this view but with the garment removed to clearly see the position of the hanger 14.

I claim:

1. A garment holding device for use in retaining a hanging garment in an item of luggage comprising a rigid hollow tube of substantially circular cross section having a first attachment means for attaching a hanger with a primary hook and neck whereby said hanger is attached to the outside surface of said tube, said tube being of a dimension such that garments on said hanger are wrapped completely around the outside surface of said tube whereby garments longer than the circumference of said tube are wrapped around onto themselves until they completely conform to the curvature of said tube, said hanger being flexible enough to conform to the curvature of said tube, said garments being held in place against outside surface of said tube by a wrap around cover having opposed ends and means to detachably secure itself to said tube and detachably secure said opposed ends wherein said cover is wrapped around said garment and tube.

2. The garment holding device of claim 1 wherein said first attachment means is a protrusion attached to said outside surface of said tube whereby said hanger may be hooked to said protrusion.

3. The garment holding device of claim 1 wherein said first attachment means is a hole in the wall of said tube whereby said hanger may be attached.

4. The garment holding device of claim 3 whereby said hanger has a secondary hook integral to the neck of the primary hook extending out of the plane of the hanger perpendicular to the primary hook, said secondary hook being substantially smaller than said primary hook and of such size and shape as to fit into said hole in said tube and secure said hanger to said tube.

5. The hanger of claim 4 whereby said secondary hook is molded integrally into the neck of said primary hook to form a hanger of one piece.

6. The garment holding device of claim 1 wherein said cover comprises a sheet of resilient material which is subsequently wrapped around said garments and said tube and pulled taught to secure said garments against outside surface of said tube thereby minimizing movement of said garments in transport.

7. The cover of claim 6 whereby said means to secure said cover around said garments and said tube consist of hook and loop fasteners attached to said opposing ends of said cover whereby said cover, after being wrapped completely around said garments and said tube and pulled taught, is detachably attached to itself by placing the opposing hook and loop fastener ends of said cover into contact and applying pressure thereby securing said hook and loop fasteners, said cover being secured to said garments and said tube by compressive force acting against said garments and said tube.

8. The cover of claim 6 whereby said resilient material is a woven fabric.

* * * * *